US005426920A

United States Patent [19]

Quadalti

[11] Patent Number: 5,426,920

[45] Date of Patent: Jun. 27, 1995

[54] EQUIPMENT FOR THE CONTINUOUS FEEDING OF BOXES TO A MACHINE KNOWN AS A BOX FILLER

[75] Inventor: Cesare Quadalti, Faenza, Italy

[73] Assignee: Senzani Brevetti - Officine Di Faenza S.r.l., Italy

[21] Appl. No.: 154,006

[22] Filed: Nov. 18, 1993

[51] Int. Cl.[6] ..... B65B 43/28; B65B 43/30

[52] U.S. Cl. ..... 53/564

[58] Field of Search ..... 53/565, 566, 389.1, 53/458, 564

[56] References Cited

U.S. PATENT DOCUMENTS

| | | | |
|---|---|---|---|
| 2,016,814 | 10/1935 | Ferguson . | |
| 2,936,681 | 5/1960 | Earp . | |
| 3,300,946 | 1/1967 | Martin | 53/566 X |
| 3,633,470 | 1/1972 | Bingham | 53/566 X |
| 3,937,131 | 2/1976 | Kellogg . | |
| 4,258,526 | 3/1981 | Focke | 53/566 X |
| 4,735,600 | 4/1988 | Drewke et al. | 53/566 X |

*Primary Examiner*—Horace M. Culver
*Attorney, Agent, or Firm*—Larson and Taylor

[57] ABSTRACT

The suction cups (23) for collecting the boxes (B) from the feed magazine (M) are mounted on a carousel (G) together with the check fingers (34) which ensure the correct introduction of the box into the box filler compartment and its retention when the box is released by the suction cups. The suction cups are mounted on the carousel with the interposition of an oscillating support (6-17-117) which, when the suction cups begin to interact with the box magazine, is orientated in advance and, by suitable means (7-8-108-9-10-11), is made to oscillate in a direction opposite that of the rotation of the said carousel, at a speed such that the motion obtained from the carousel is neutralized and the box can be extracted from the magazine, substantially with the same means as used in present static devices, from which the equipment described herein differs in the possibility of operation with continuous motion and consequently with higher output.

8 Claims, 5 Drawing Sheets

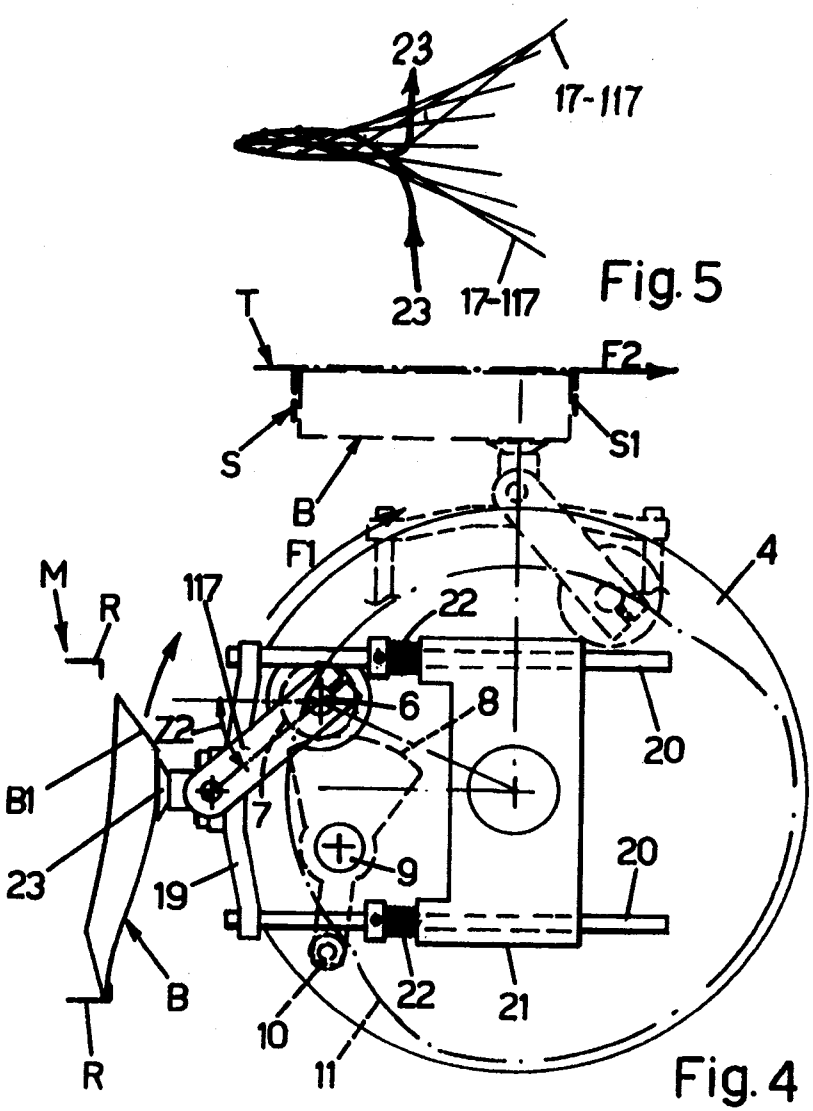
Fig. 5
Fig. 4
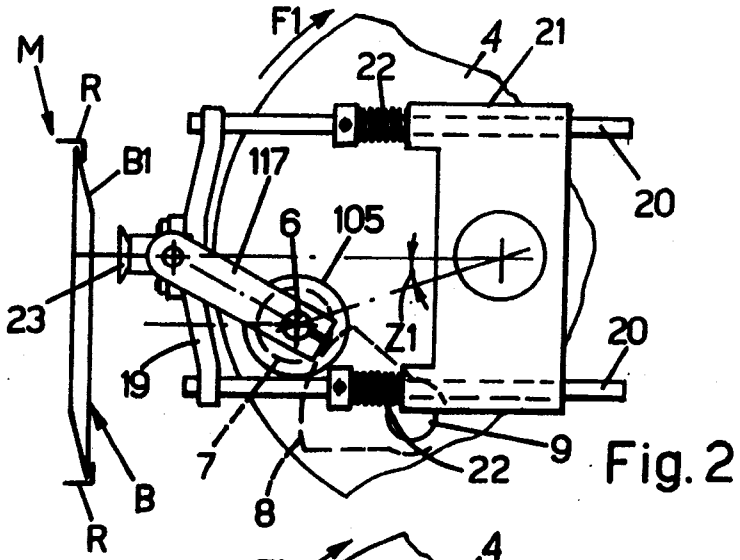
Fig. 2
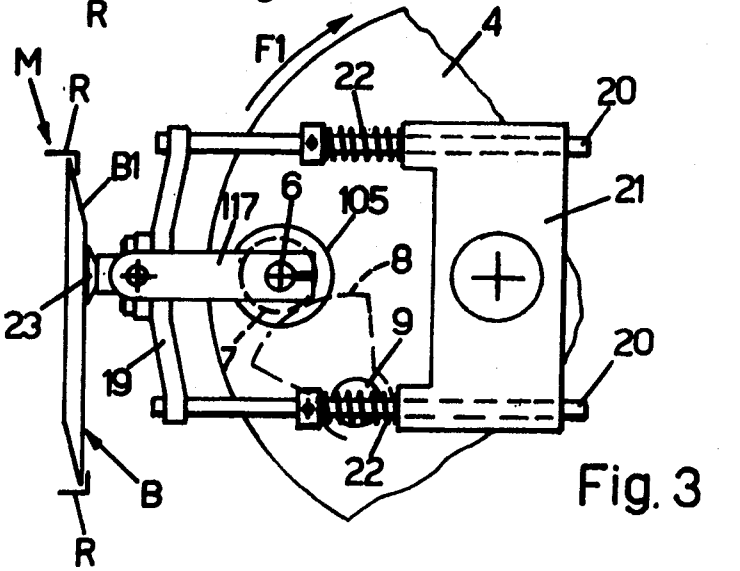
Fig. 3

EQUIPMENT FOR THE CONTINUOUS FEEDING OF BOXES TO A MACHINE KNOWN AS A BOX FILLER

DESCRIPTION

The invention relates to equipment for the continuous feeding of preformed boxes to a machine which fills the boxes with the product, and is known as a box filler; according to the position adopted by the box in the filling phase, this machine may equally well be of either the vertical or the horizontal type.

In current machines, the preformed boxes, already made into tubes, flattened and stacked in the form in which they arrive from the paper and board manufacturer, are disposed in a horizontal or vertical magazine, at one end of which there operate suction cups, usually static and with cyclic movement, which extract one box at a time from the magazine, open it in what is known as a squaring operation and, with the aid of other checking means, also normally static and with cyclic movement, insert the box into one of the compartments of the box filler. The cyclic movement of the box feed means limits the output of the latest generation of box fillers which operate with continuous motion and which are capable of very high rates, of the order of as much as 350–400 boxes per minute.

The present invention is designed to avoid these and other disadvantages with equipment in which the suction cups for collecting the boxes from the feed magazine are mounted on continuous movement means of carousel or equivalent type, together with the checking means which ensure the correct introduction of the box into the compartment of the box filler and its retention when the box is released by the suction cups. The suction cups are mounted on the carousel with the interposition of an oscillating support which, when the suction cups begin to interact with the box feed magazine, is orientated in advance and is made to oscillate in a direction opposite that of the rotation of the said carousel, at a speed such that the motion obtained from the carousel is neutralized and the box can be extracted from the magazine, substantially with the same means as used in present static devices. Unlike these known devices, the equipment described herein is no longer obliged to carry out return movements, since it only has to move in one direction between the magazine and the compartment of the box filler to be fed, and can therefore be adapted to the continuous movement and high operating rates of present box fillers.

These and other characteristics of the invention, and the advantages derived therefrom, will be clearly understood from the following description of a preferred embodiment of the invention, illustrated purely by way of example and without restriction in the figures on the five attached sheets of drawings, in which FIG. 1 is a lateral perspective view of the equipment;

FIGS. 2, 3 and 4 are schematic plan views of a working unit of the equipment, seen in the significant phases of respectively grasping, extracting and transferring the box from the feed magazine to a compartment of the box filler;

FIG. 5 is a schematic diagram of the movement of the suction cups in their interaction with the box feed magazine;

Figure 1:
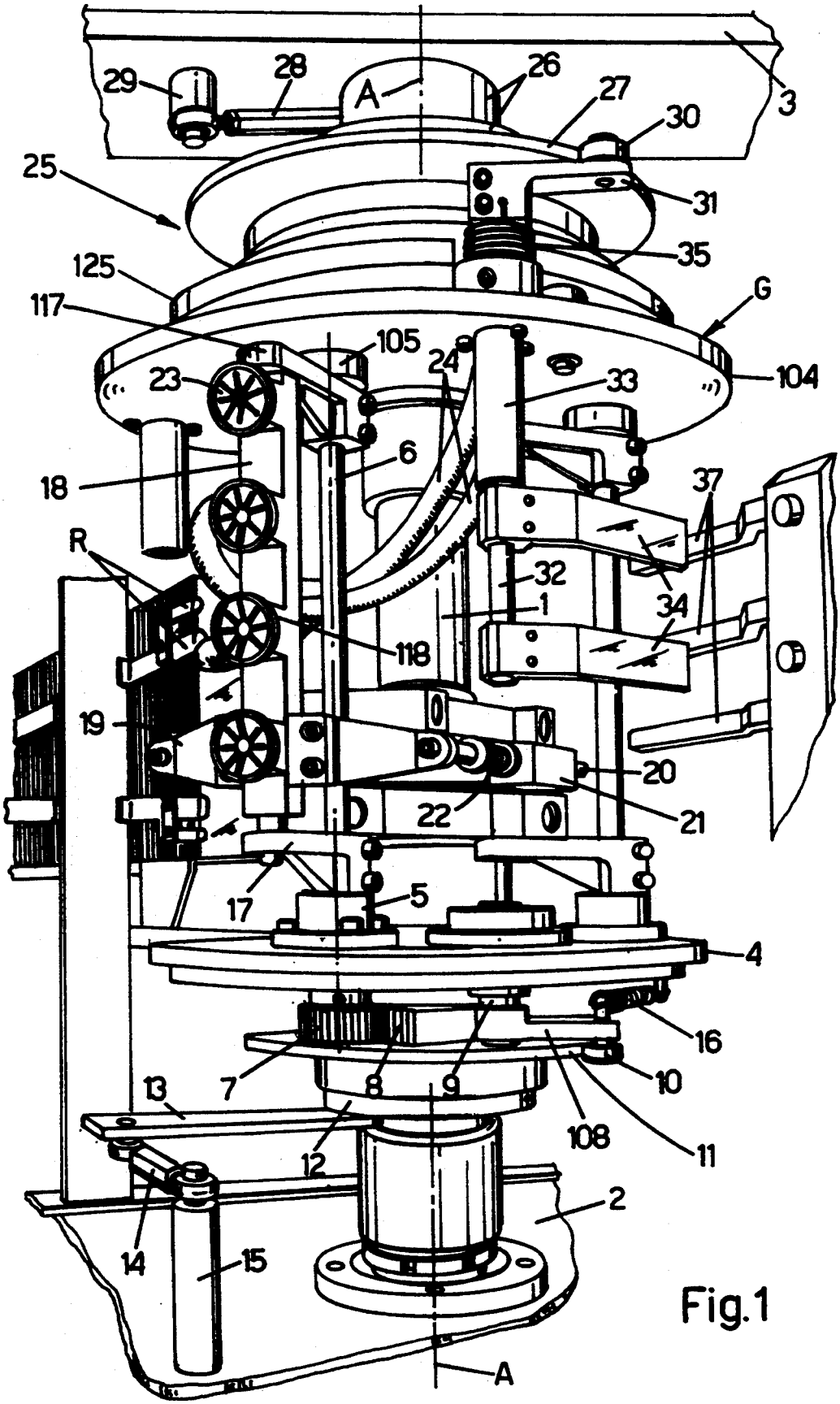

With reference initially to FIGS. 1 to 5, it may be seen that the equipment comprises a carousel G rotating about an axis A parallel to that of the final drives of the transfer device or of the carousel of the box filler T, which carries the equidistant compartments S to which the equipment has to feed at the correct time a box B, collecting it from a magazine M where the boxes are stacked.

In the example described here, the magazine M is horizontal, being interlocked with what is known as a vertical box filler, and the axis A of the carousel G is vertical. The boxes B are disposed vertically, with what is to be the leading wall B1 in the following movement on the box filler facing in the direction of the box filler, and rest on a conveyor which keeps them in order and pressed against the outlet of the magazine where the leading box is retained by curved stops R, of a known type, which are partially rigid and partially elastic. A plate controlled by a cam may be provided in place of the appendages R disposed on the rear side of the magazine. The magazine M may be disposed at between ninety and one hundred and eighty degrees from the point at which the carousel cyclically transfers the boxes into compartments of the box filler.

The carousel comprises a vertical shaft 1 which is made to rotate by suitable means in the direction of the arrow F1, continuously and in phase with the movement of the box filler transfer device in the direction of the arrow F2. The shaft 1 is supported rotatably by opposing and fixed supports 2–3 and two horizontal and identical plates 4–104 are fixed on the shaft. These plates support rotatably, by means of supports with bearings 5–105, the ends of one or more vertical shafts 6 at equal distances from each other and from the axis A of the carousel G.

The shaft 6 passes through the lower support 5 and has keyed to it a pinion 7 which engages with a toothed sector 8 of greater diameter (for example with a ratio of ⅓) oscillating on a vertical pin 9 carried on the lower side of the plate 4, the sector being integral with a lever 108 with an end roller 10 which follows the profile of a cam 11 mounted on a support 12 through which the shaft 1 passes rotatably and which is integral with an arm 13 connected by an adjustable link 14 to a post 15 fixed to the support 2.

In the present example, the cam 11 is of the single-acting type and the roller 10 of the lever 108 is held against this cam by a return spring 16. However, it should be understood that the spring may be omitted and a double-acting cam used in place of the illustrated cam 11.

On the section of shaft 6 lying between the plates 4–104 of the carousel G, there are fixed horizontally and with identical orientation a pair of identical arms 17–117 which rotatably support the ends of a vertical bar 18 to which is symmetrically fixed a cross-piece 19 which in turn is fixed by its ends to the ends of horizontal rods 20 which slide axially in the corresponding channels of a guide support 21 freely rotatable on the shaft 1. Corresponding elastic dampers 22 are mounted on the rods 20 between the cross-piece 19 and the support 21.

The bar 18 has, on one of its faces, equally spaced projections 118 with suction cups 23 communicating with passages inside the bar. The suction cups 23 are connected, in such a way that they can be selectively activated according to the dimensions of the boxes to be manipulated, by means of ducts 24, to a rotary distributor 25. The rotary distributor 25 is disposed above the plate 104 of the carousel G and has a lower part 125 fixed to the plate 104 and connected to the ducts 24, and an upper part 225 fixed to a support 26 through which the shaft 1 passes rotatably and which is connected to the suction source and to a compressed air source if present. This whole configuration will be apparent to and can easily be constructed by persons skilled in the art.

The support 26 has mounted on it a cam 27 connected adjustably, as shown previously for the lower cam 11, to an arm (not shown), to an adjustable link 28 and to a post 29 fixed to the support 3. The cam 27 interacts with the end roller 30 of a lever 31 fixed on the upper end of a vertical shaft 32 mounted rotatably in a tube 33 fixed to the plate 104. The shaft 32 projects below the plate 104 and carries a pair of suitably shaped fingers 34. A wire spring 35 ensures the constant interaction of the roller 30 with the cam 27.

The equipment designed in this way operates as follows. During the rotation of the carousel G, each grasping unit with suction cups 23 begins to interact with the magazine M in the condition shown in FIG. 2, with the arms 17–117 oriented in advance by an angle Z1 of sufficient size, for example approximately 30°–33° while the suction cups are disposed radially with respect to the carousel, substantially perpendicular to the leading box of the magazine and at a short distance from the wall B1 of the box. At the correct time, while the carousel G continues to rotate at the predetermined speed, the roller 10 (FIG. 1) interacts with a recessed part of the cam 11 and the gears 7–8 rotate so that the arms 17–117 are made to oscillate in a direction opposite that of the rotation of the carousel and at such a speed that the suction cups, which are also guided by the parts 19–20–21, move along the path shown in FIG. 5. The suction cups enter into contact initially with the leading box B and pressing it gently into the magazine when the arms 17–117 are radially disposed with respect to the carousel as in FIG. 3, and then withdraw from the magazine with a slight reverse movement to extract the front part of the box from the magazine and to start the opening of the box as shown in FIG. 4.

In the example illustrated, the arms 17–117 have rotated backwards through an angle Z2 of approximately 40°–41°. At this point the suction cups follow the rotation of the carousel. The box is pulled off from behind by the corresponding appendages R or by the cam plate of the magazine M and is transferred to the box filler.

Figure 6:
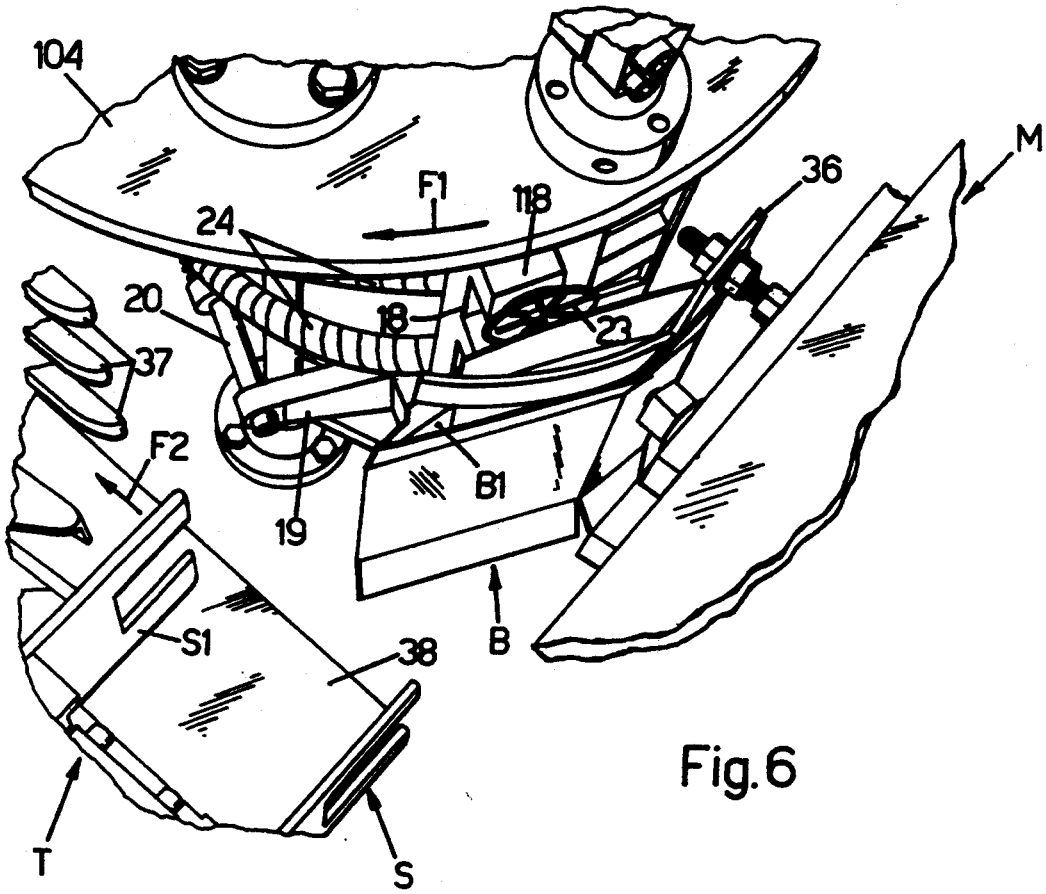
FIGS. 6, 7, 8, 9, 10 and 11 are perspective and plan views of the significant parts of the equipment during the same number of phases of transfer of a box from the feed magazine to a compartment of the box filler.
Figure 7:
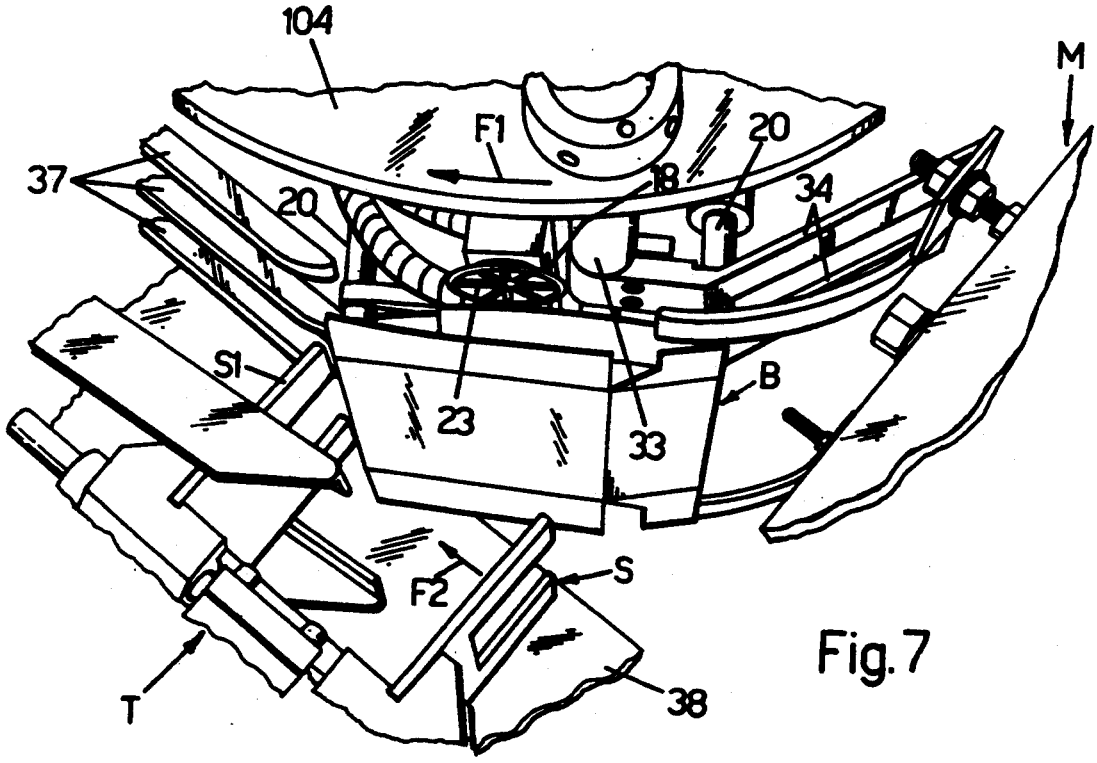

During this phase, the lower and upper flaps of the box interact with curved fixed guides 36, as shown in FIGS. 6 and 7, which have the function of forcing the box to open and keeping it correctly and partially opened. FIG. 7 shows how, as a result of the reverse rotation of the arms 17–117, the bar carrying the suction cups 23 and the box is at a small distance from the shaft 32 with the fingers 34 which are thus disposed behind the box.

Figure 8:
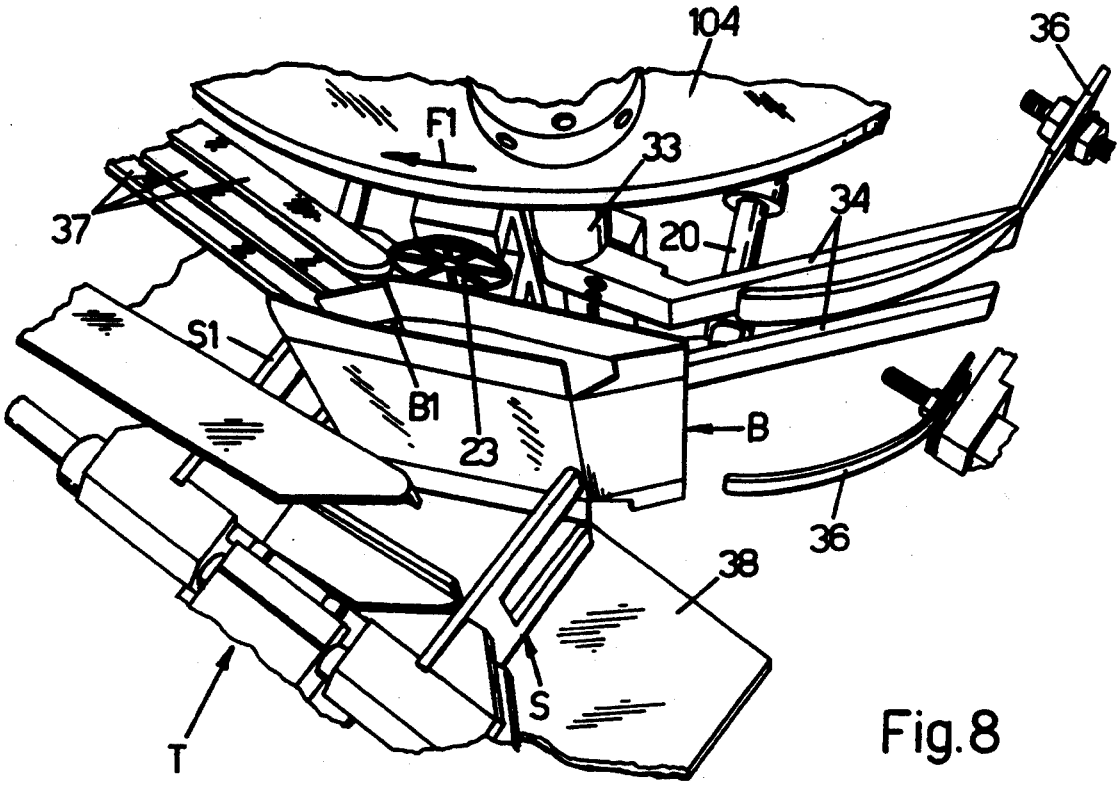

FIG. 8 shows that the position of the carousel G with respect to the box filler is such that the front edge of the box retained by the suction cups of the carousel begins to interact with the inner side of the front wall S1 of a compartment S of the box filler. The compartment S moves in the direction of the arrow F2 at a speed lower than the peripheral rotation speed of the box, so that the wall B1 of the box rotates and is disposed gradually in contact with the wall S1 of the compartment, while the box is opened completely and is inserted progressively into the compartment.

Figure 9:
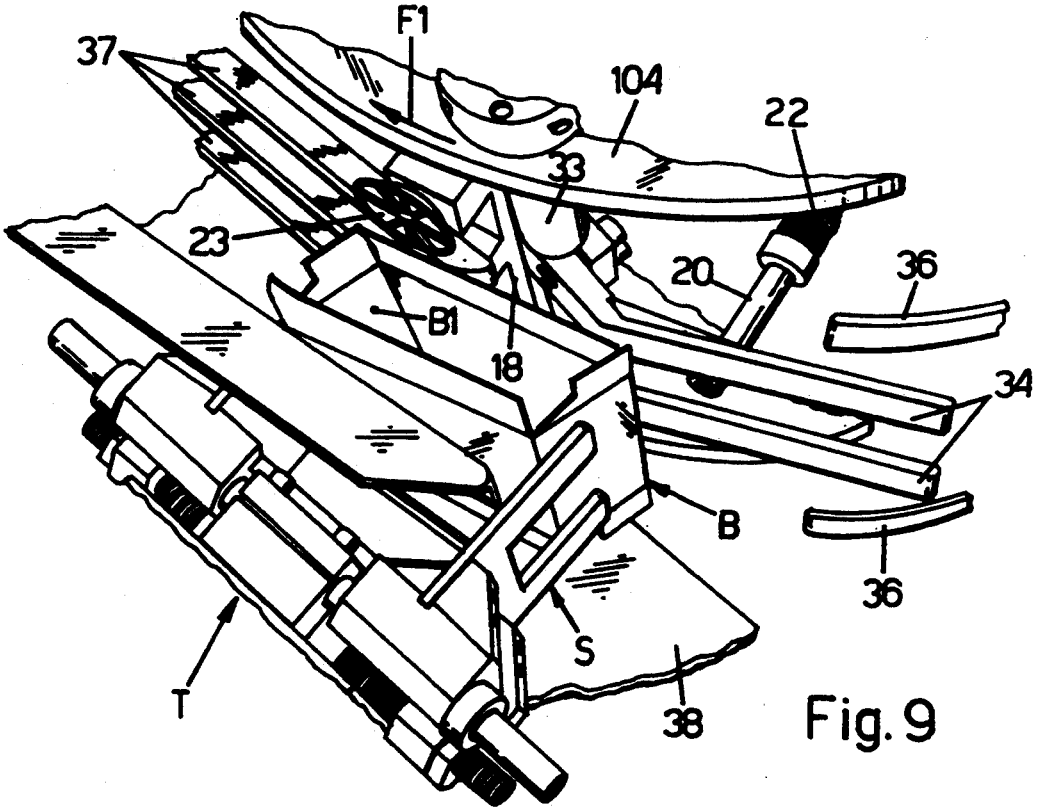
Figure 10:
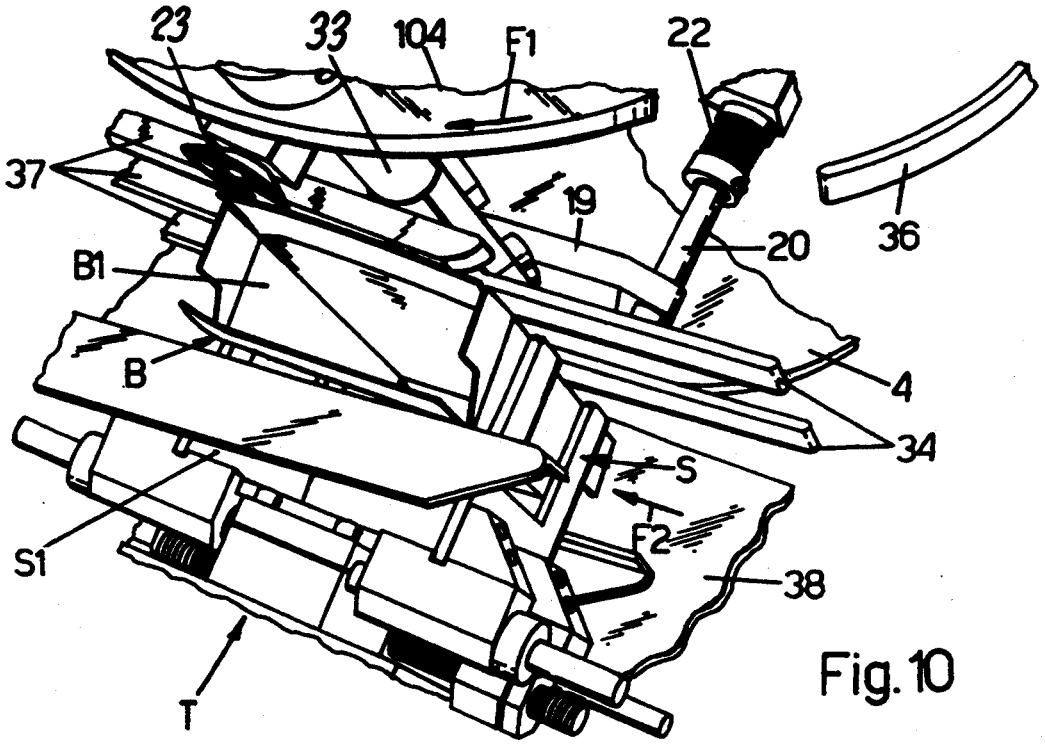
Figure 11:
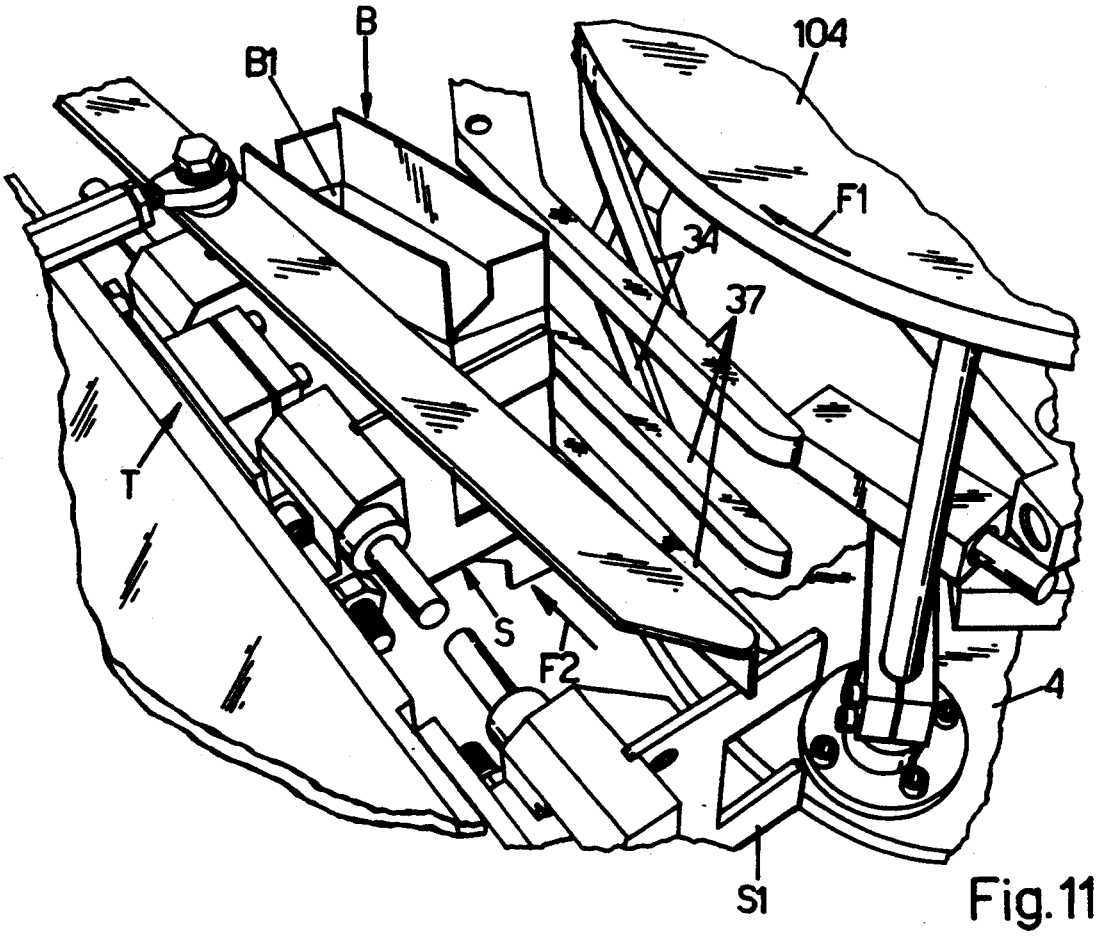

As shown in the sequence of FIGS. 9–10–11, while the box is inserted into the compartment of the box filler and the compartment is moved in the direction F2, the box begins to interact with the leading rounded part of longitudinal fixed guides 37 and is released by the suction cups 23 at the correct time and is finally pushed into the compartment by the fingers 34. The fingers 34 move between the guides 37 and undergo an appropriate oscillation with the shaft 32, as a result of the interaction of the roller 30 with a projecting part of the cam 27. A fixed guide 38 supports the box in the compartment S.

When the box has been inserted into the compartment, the fingers 34 and the arms 17–117 return to the necessary orientation for the performance of another operating cycle. Since a number of suction cup units are mounted on the carousel G at equal angular intervals, one suction cup unit is performing the cycle while another unit is being prepared for the repetition of the cycle. The equipment described herein is thus capable of continuously feeding a box to each compartment S of the box filler and of being adapted without problems to the operating speeds, even if high, of the box filler.

It is to be understood that the description refers to a preferred embodiment of the invention, to which numerous variations and modifications may be made, particularly as regards construction, without thereby departing from the guiding concept of the invention as described above, as illustrated and as claimed below.

I claim:

1. Equipment for the continuous feeding of boxes to a box filler, the boxes being preformed and stacked in a magazine in the same orientation as that in which they are to be fed to said box filler, said equipment comprising:

a unit having suction cups for grasping and transferring the boxes from the magazine to the box filler;

a continuous movement device rotating in at least one axis parallel to the axis or axes of rotation of the box filler;

supporting means for mounting said suction cups on said continuous movement device, said supporting means comprising a vertical bar on which said suction cups are mounted and a pair of arms rotatably supporting ends of said vertical bar;

oscillating means for oscillating said pair of arms in a direction opposite the rotation of said continuous movement device;

guide means for controlling movement of said supporting means, said guide means causing said suction cups to grip a lateral wall following a leading wall of the box being transferred, wherein the box being transferred is pulled off of the magazine via said oscillating means, curved fixed guides forcing the box being pulled off of the magazine to partially open, rotation of said continuous movement device and operation of said guide means causing a front edge of said leading wall of the box being transferred to contact an inner face of a front wall of the compartment of the box filler, wherein peripheral speed of the movement of the box being transferred is greater than speed of advance of the compartment and the front wall progressively opens the box being transferred;

longitudinal fixed guides for guiding the box being transferred into the compartment;

check means for pushing the box being transferred into the compartment and breaking contact between said suction cups and the box being transferred; and means for positioning said unit to a predetermined orientation.

2. Equipment according to claim 1, further comprising additional units having suction cups mounted at equal intervals around said continuous movement device.

3. Equipment according to claim 2, wherein said continuous movement device is a carousel and said check means comprises, behind each unit having suction cups and at an equal distance from the unit, oscillating fingers, completing the insertion of the box being transferred into the compartment and causing the suction cups to release the box being transferred, and means for returning said oscillating fingers to a predetermined position.

4. Equipment recited in claim 3, wherein said fingers move between said fixed longitudinal guides.

5. Equipment as recited in claim 1, further comprising:

a first vertical shaft, wherein said pair of arms are parallel and horizontal and are fixed to the ends of said first vertical shaft;

said continuous movement device further comprising parallel plates, said first vertical shaft being rotatably mounted on the periphery of said parallel plates, a lower end of said first vertical shaft projecting from a lower plate of said parallel plates, and a second vertical shaft central to said continuous movement device;

said oscillating means comprising:

a pinion keyed to said lower end of said first vertical shaft;

a toothed sector engaging with said pinion, said toothed section being rotatable on said lower plate, and a first lever, associated with said toothed sector, having a first roller at one end, said roller following a profile of a first fixed cam; and said guide means comprising:

a first support which is freely rotatable on said second vertical shaft and housing channels;

horizontal rods sliding axially in said channels of said first support;

a cross-piece integral with the ends of said horizontal rods and fixed on said vertical bar, and dampers mounted on said horizontal rods between said cross-piece and said first support.

6. Equipment according to claim 5, wherein said vertical bar further comprises means for connecting said suction cups with a rotary distributor, said rotary distributor being disposed in an upper end of said continuous movement level, an upper part of said rotary distributor being fixed to a second support, a second fixed cam mounted on said second support, a second lever having a second roller, said second lever keyed to an upper end of a third vertical shaft which is rotatably supported by an upper plate of said parallel plates of said continuous movement device, said second fixed cam interacting with said second roller, and said check means comprises oscillating fingers for completing the insertion of the box being transferred into the compartment, said oscillating fingers being mounted on a lower end of said vertical shaft.

7. Equipment according to claim 1, wherein said curved, fixed guides maintain the box being pulled off of the magazine in the partially opened position until the front edge of the leading wall of the box being transferred contacts the inner face of the front wall of the compartment.

8. Equipment according to claim 5, wherein said cross-piece is fixed symmetrically on said vertical bar.

* * * * *